US011713205B2

(12) United States Patent
Sawamura

(10) Patent No.: US 11,713,205 B2
(45) Date of Patent: Aug. 1, 2023

(54) SWITCHING DEVICE FOR SWITCHING TRANSPORT DIRECTIONS OF RECORDING MEDIUM, AND IMAGE FORMING APPARATUS

(71) Applicant: FUJIFILM Business Innovation Corp., Tokyo (JP)

(72) Inventor: Jun Sawamura, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 646 days.

(21) Appl. No.: 16/751,463

(22) Filed: Jan. 24, 2020

(65) Prior Publication Data

US 2021/0039910 A1 Feb. 11, 2021

(30) Foreign Application Priority Data

Aug. 9, 2019 (JP) ..... 2019-147309

(51) Int. Cl.

| | |
|---|---|
| ***B65H 29/60*** | (2006.01) |
| ***G03G 15/00*** | (2006.01) |
| ***B65H 29/12*** | (2006.01) |

(52) U.S. Cl.

CPC ..... *B65H 29/60* (2013.01); *B65H 29/12* (2013.01); *G03G 15/6529* (2013.01); *B65H 2601/521* (2013.01); *B65H 2601/524* (2013.01); *G03G 2215/00675* (2013.01)

(58) Field of Classification Search

CPC . B65H 5/36; B65H 3/66; B65H 29/58; B65H 29/60; B65H 2601/521; B65H 2601/524; G03G 2215/00675

See application file for complete search history.

(56) References Cited

U.S. PATENT DOCUMENTS

| | | | | |
|---|---|---|---|---|
| 5,810,353 | A * | 9/1998 | Baskette | B65H 31/22 271/298 |
| 8,838,008 | B2 * | 9/2014 | Nara | G03G 15/6552 399/361 |
| 9,540,206 | B2 * | 1/2017 | Masuda | B65H 29/14 |
| 9,573,786 | B2 * | 2/2017 | Moon | B65H 29/58 |
| 10,604,370 | B2 * | 3/2020 | Yamamoto | B65H 31/24 |
| 11,027,938 | B2 * | 6/2021 | Watanabe | G03G 15/6573 |
| 11,034,540 | B2 * | 6/2021 | Miyauchi | G03G 15/6529 |
| 11,079,709 | B2 * | 8/2021 | Sakurai | G03G 15/6576 |
| 2005/0208885 | A1 * | 9/2005 | Huang | B65H 29/58 451/326 |

FOREIGN PATENT DOCUMENTS

JP 2013-245037 A 12/2013

* cited by examiner

*Primary Examiner* — Patrick Cicchino

(74) *Attorney, Agent, or Firm* — Sughrue Mion, PLLC

(57) ABSTRACT

A switching device for switching transport directions of a recording medium includes a switching member and at least one rotation stopper. The switching member is configured to switch transport paths of the recording medium. The at least one rotation stopper is configured to hit the switching member to stop rotation of the switching member. The at least one rotation stopper is disposed asymmetrically in a direction perpendicular to a transport direction in which the switching member transports the recording medium.

13 Claims, 10 Drawing Sheets

SWITCHING DEVICE FOR SWITCHING TRANSPORT DIRECTIONS OF RECORDING MEDIUM, AND IMAGE FORMING APPARATUS

CROSS-REFERENCE TO RELATED APPLICATION(S)

This application is based on and claims priority under 35 USC 119 from Japanese Patent Application No. 2019-147309 filed on Aug. 9, 2019.

BACKGROUND

(i) Technical Field

The present disclosure relates to a switching device for switching transport directions of a recording medium, and an image forming apparatus.

(ii) Related Art

JP-A-2013-245037 discloses a switching mechanism for switching transport paths. The switching mechanism is provided at a position where a transport path on which a sheet-shaped member is transported branches into plural transport paths. The switching mechanism includes a switching pawl, a stopper member, and an elastic member. The switching pawl is swingably provided on a base. The switching pawl guides the sheet-shaped member to any of the transport paths. The stopper member is movably provided on the base. The stopper member comes into contact with the switching pawl to thereby hold the switching pawl at a predetermined switching position. The elastic member is provided at a contact portion between the switching pawl and the stopper member. A collapse amount of the elastic member due to the contact of the switching pawl at the predetermined switching position can be adjusted by moving the stopper member.

SUMMARY

Aspects of non-limiting embodiments of the present disclosure relate to a switching device for switching transport directions of a recording medium that reduces rebounding of a switching member when the switching member that switches transport paths of the recording medium hits a rotation stopper as compared with a case where a rotation stopper is provided at a symmetrical position in a direction perpendicular to a transport direction in which the switching member transports the recording medium, and an image forming apparatus.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a switching device for switching transport paths of a recording medium includes a switching member and at least one rotation stopper. The switching member is configured to switch the transport paths of the recording medium. The at least one rotation stopper is configured to hit the switching member to stop rotation of the switching member. The at least one rotation stopper is disposed asymmetrically in a direction perpendicular to a transport direction in which the switching member transports the recording medium.

BRIEF DESCRIPTION OF THE DRAWINGS

Exemplary embodiment(s) of the present disclosure will be described in detail based on the following figures, wherein.

DETAILED DESCRIPTION

Hereinafter, exemplary embodiments of the present disclosure will be described with reference to the drawings.

Figure 1:
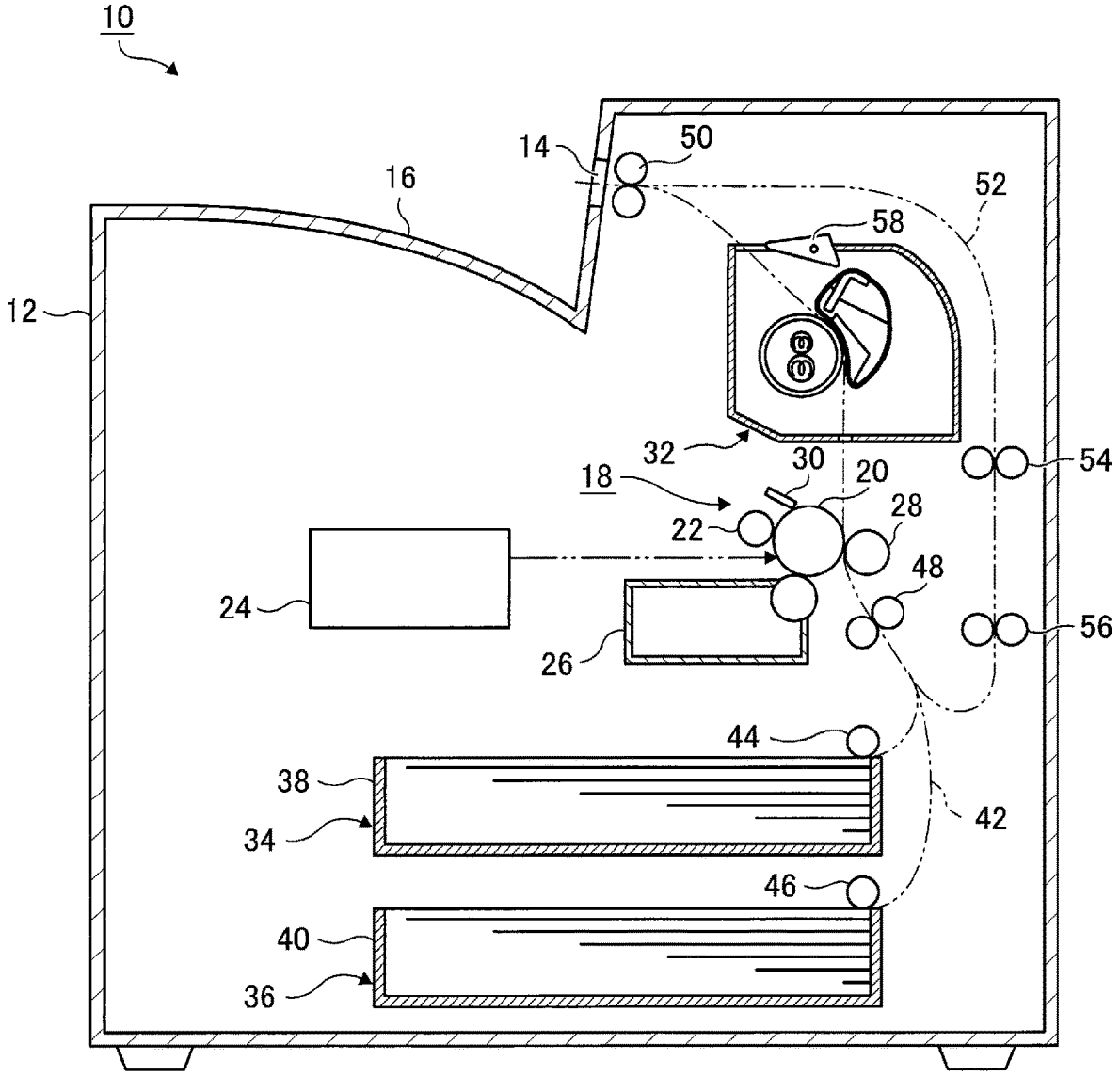
FIG. 1 is a side sectional view showing an image forming apparatus according to a first exemplary embodiment of the present disclosure.

FIG. 1 shows an image forming apparatus 10 according to a first exemplary embodiment of the present disclosure. The image forming apparatus 10 includes an apparatus body 12. The apparatus body 12 is formed with a discharge port 14 through which a sheet used as a recording medium is discharged. An upper surface of the apparatus body 12 is used as a discharge portion 16 to which a sheet onto which a developer image is fixed is discharged.

An image forming unit 18 that forms the developer image on the sheet is disposed in the apparatus body 12. The image forming unit 18 includes a photoconductor drum 20, a charging device 22, a latent image forming device 24, a developing device 26, a transfer device 28, and a cleaning device 30. The photoconductor drum 20 is used as an image carrier that carries an image. The charging device 22 uniformly charges a surface of the photoconductor drum 20. The latent image forming device 24 forms an electrostatic latent image on the surface of the photoconductor drum 20 uniformly charged by the charging device 22. The developing device 26 develops the latent image formed by the latent image forming device 24, with a developer. The transfer device 28 transfers, onto the sheet, the developer image formed by the developing device 26 developing the latent image on the surface of the photoconductor drum 20. The cleaning device 30 removes the developer remaining on the surface of the photoconductor drum 20 after the developer image is transferred to the sheet by the transfer device 28.

A fixing device 32 is disposed in the apparatus body 12. The fixing device 32 fixes, onto the sheet, the developer image formed on the sheet by the image forming unit 18. The fixing device 32 will be described later in detail.

Recording medium supply devices 34, 36 are disposed in the apparatus body 12. The recording medium supply devices 34, 36 supply the recording media to the image forming unit 18. The recording medium supply devices 34, 36 include recording medium storage portions 38, 40 and feed rollers 44, 46. The recording medium storage portions 38, 40 store the recording media in a stacked state. The feed rollers 44, 46 feed the recording media stored in the recording medium storage portions 38, 40 to a main transport path 42 which will be described later.

The main transport path 42 is a transport path from the recording medium storage portions 38, 40 to the discharge port 14. The recording medium storage portions 38, 40, registration rollers 48, a transfer portion between the photoconductor drum 20 and the transfer device 28, the fixing device 32, and a discharge roller 50 are arranged on the main transport path 42 in order from the upstream in the transport direction of the recording medium.

The registration rollers 48 temporarily stop movement of a leading end portion of the recording medium supplied from any one of the recording medium supply devices 34, 36, and resume the movement of the leading end portion of the sheet to the transfer portion formed by the photoconductor drum 20 and the transfer device 28, in accordance with a timing at which a toner image is formed on the surface of the photoconductor drum 20.

The transfer device 28 electrostatically transfers the toner image formed on the surface of the photoconductor drum 20 to the recording medium by an applied transfer bias.

The discharge roller 50 discharges the recording medium onto which the toner image is fixed by the fixing device 32, toward the discharge portion 16 such that the recording medium passes through the discharge port 14. When a developer image is to be formed on one surface of the recording medium on which the developer image has been formed on the other surface thereof, the discharge roller 50 starts to rotate in a reverse direction at a timing at which a portion of the recording medium close to the trailing end portion thereof reaches the discharge roller 50. Thereby, the discharge roller 50 feeds the recording medium on which the developer image is formed on the other surface to an inverting transport path 52 with the previous trailing end portion become a leading end portion.

The inverting transport path 52 is a transport path from the discharge port 14 to the registration rollers 48. For example, transport rollers 54 and transport rollers 56 are arranged on the inverting transport path 52 in order from the upstream in a transport direction of the recording medium. The transport rollers 54, 56 invert the recording medium on which the toner image is formed on the other surface thereof while transporting the recording medium toward the registration rollers 48.

A switching device 58 for switching transport directions of a recording medium is disposed on an outlet side of the fixing device 32. The "switching device 58 for switching transport directions of a recording medium" may be simply referred to as a "switching device 58". The switching device 58 will be described in detail later. The switching device 58 switches the transport path of the recording medium between the main transport path 42 and the inverting transport path 52.

Figure 2:
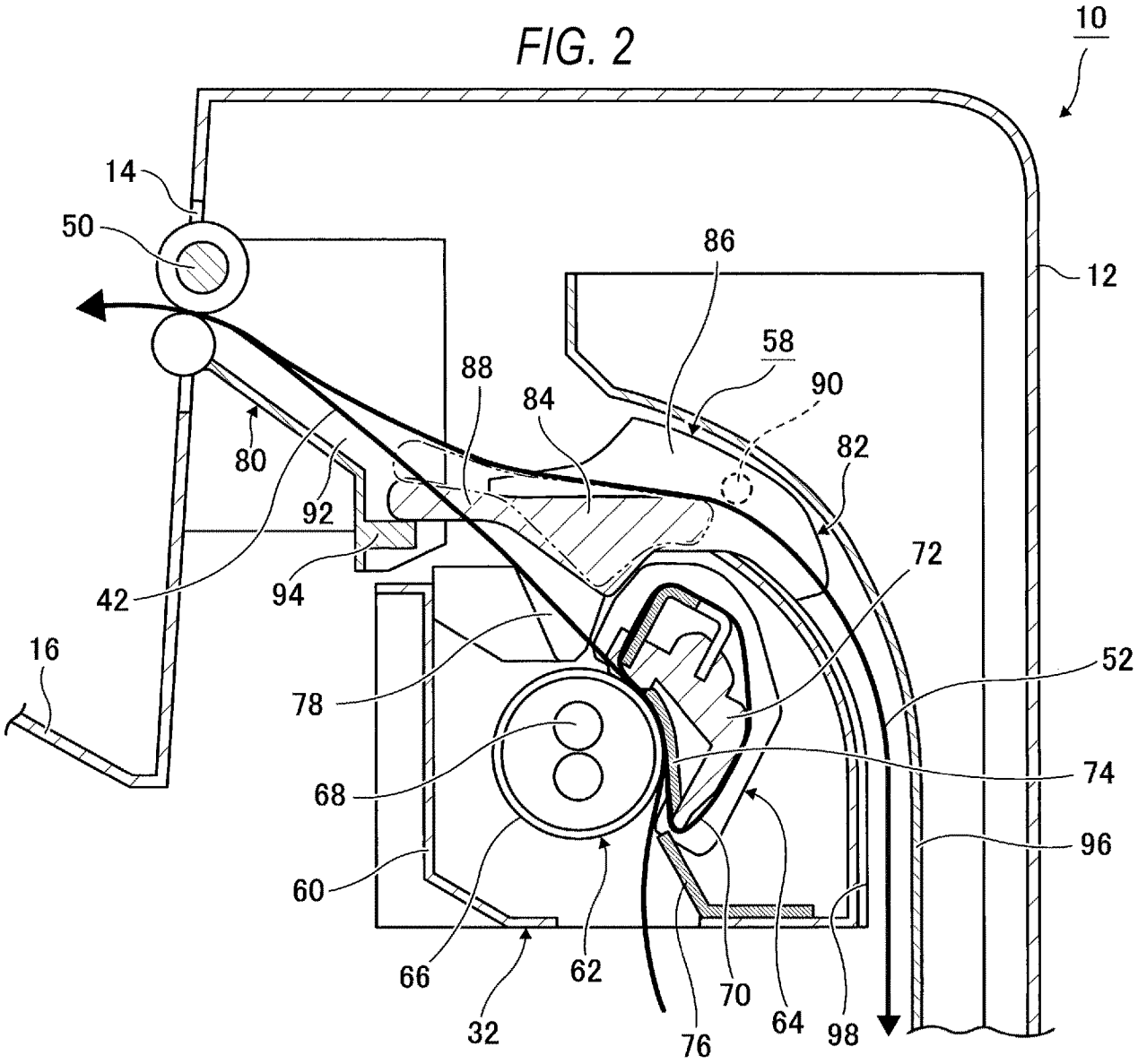
FIG. 2 is a side sectional view showing a fixing device according to the first exemplary embodiment of the present disclosure and surroundings thereof.

FIG. 2 shows the fixing device 32 according to the first exemplary embodiment of the present disclosure and surroundings thereof.

The fixing device 32 includes a device body 60. A heating roller 62 and a pressure unit 64 are disposed in the device body 60. The heating roller 62 includes a cylindrical roller portion 66 and heaters 68 disposed in the roller portion 66. The roller portion 66 is heated by energizing the heaters 68.

The pressure unit 64 includes an endless belt 70, a belt guide member 72, and a pressure portion 74. The endless belt 70 serves as an endless belt-shaped body. The belt guide member 72 rotatably guides the endless belt 70. The pressure portion 74 is disposed inside the endless belt 70. The pressure portion 74 is pressed against the heating roller 62 together with the endless belt 70.

The endless belt 70 is provided between the heating roller 62 and the pressure portion 74. The heating roller 62 and the endless belt 70 are brought into pressure contact with the pressure portion 74, so that the toner image is fixed onto the recording medium passing through a position between the heating roller 62 and the endless belt 70.

An inlet guide member 76 is disposed on an inlet side of the fixing device 32. The inlet guide member 76 is fixed to the device body 60. An outlet guide member 78 is disposed on the outlet side of the fixing device 32. The outlet guide member 78 is fixed to the device body 60. A discharge guide member 80 is further provided in the apparatus body 12 downstream of the outlet guide member 78 in the transport direction of the recording medium on the main transport path 42.

Figure 3:
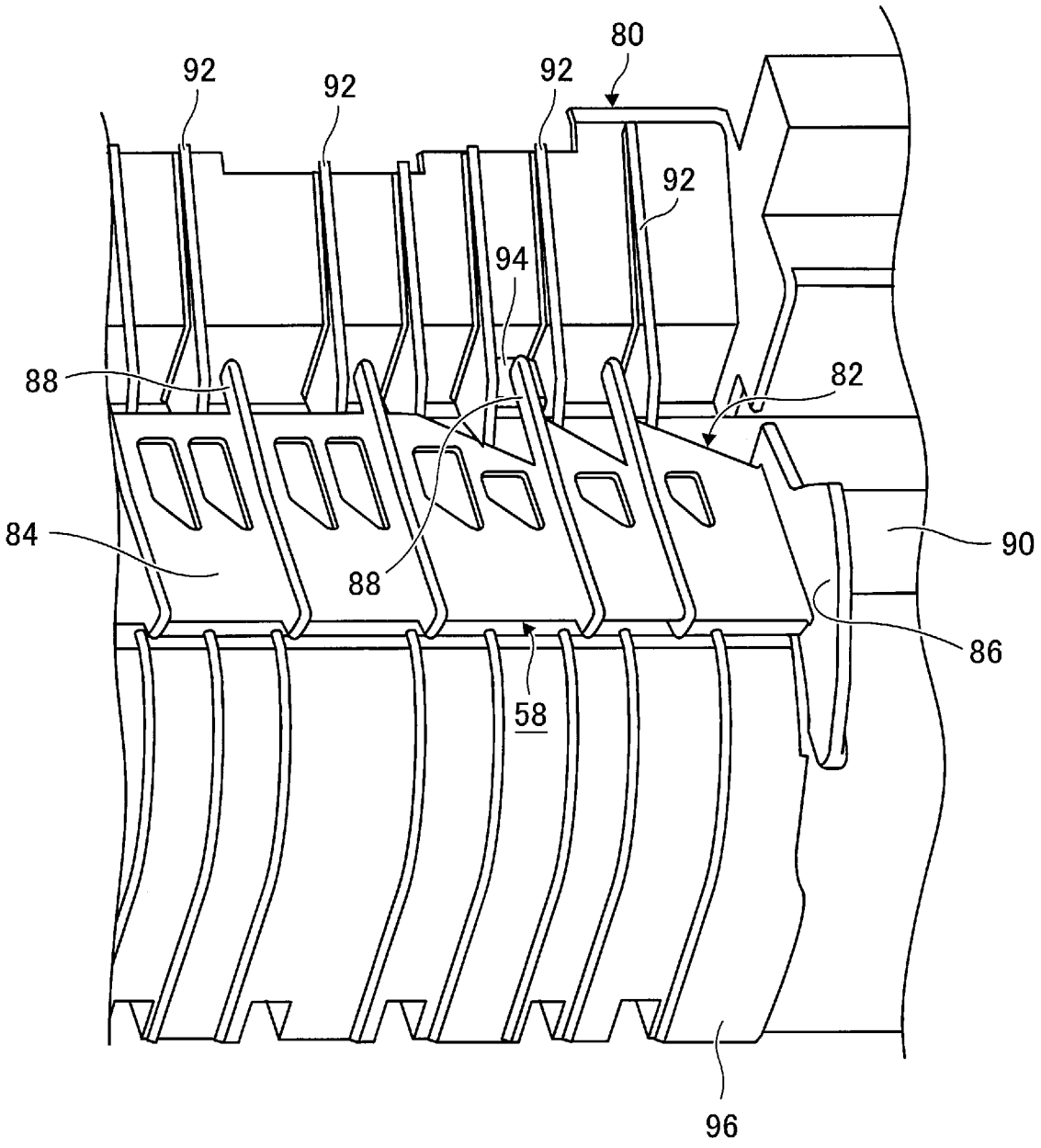
FIG. 3 is an enlarged perspective view showing a switching device for switching transport directions of a recording medium (hereinafter, which may be simply referred to as a "switching device") according to the first exemplary embodiment of the present disclosure and surroundings thereof.

The switching device 58 includes a switching member 82 that closes an outlet of the device body 60. As shown in FIG. 3, the switching member 82 includes a plate-shaped switching member body 84, regulating portions 86, and plural guide portions 88. The switching member body 84 extends in a direction perpendicular to the transport direction of the recording medium. The regulating portions 86 are provided at both ends of the switching member body 84 in the direction perpendicular to the transport direction of the recording medium. The guide portions 88 are arranged on the switching member body 84 in the direction perpendicular to the transport direction of the recording medium. The regulating portions 86 extend upward at both ends of the switching member body 84, and regulate movement of the recording medium in the direction perpendicular to the transport direction of the recording medium.

The switching member 82 includes a rotation shaft 90 that protrudes from the regulating portions 86 in the direction perpendicular to the transport direction of the recording medium. The switching member 82 is supported by the device body 60 so as to be rotatable about the rotation shaft 90.

The guide portion 88 of the switching member 82 protrudes from upper and lower surfaces of the switching member body 84. The guide portion 88 also protrudes toward the discharge guide member 80. The discharge guide member 80 is formed with plural discharge guide portions 92 arranged in the direction perpendicular to the transport direction of the recording medium. The discharge guide portion 92 protrudes upward and toward the guide portion 88 of the switching member 82. The guide portions 88 and the discharge guide portions 92 are arranged alternately in the direction perpendicular to the transport direction of the recording medium.

In this first exemplary embodiment, a rotation stopper 94 is provided between the discharge guide portions 92 of the discharge guide member 80. The guide portion 88 of the switching member 82 hits this rotation stopper 94 to prevent the switching member 82 from rotating counterclockwise in FIG. 2. The rotation stopper 94 may be formed of a synthetic resin such that the rotation stopper 94 integrated with the discharge guide member 80. Alternatively, a surface portion of the rotation stopper 94 which the guide portion 88 hits or the whole rotation stopper 94 may be formed of a material, for example, a rubber or a sponge, that is more easily elastically deformed than a material of the discharge guide member 80.

The leading end of the recording medium that passes the position between the heating roller 62 and the endless belt 70 is guided by the outlet guide member 78 and hits a lower surface of the guide portion 88 of the switching member 82. Due to the stiffness of the recording medium, the switching member 82 is rotated clockwise in FIG. 2. When the recording medium is further transported, the recording medium is guided to the discharge guide member 80 and discharged to the discharge unit 16 in response to driving of the discharge roller 50.

When an image is formed only on one surface of the recording medium, the recording medium is directly discharged to the discharge portion 16. On the other hand, when images are formed on both surfaces of the recording medium, the discharge roller 50 rotates in reverse at a timing at which the trailing end of the recording medium passes the guide portions 88 of the switching member 82. When the trailing end of the recording medium passes the guide portions 88, the switching member 82 rotates counterclockwise in FIG. 2 by own weight, and is stopped by the guide portions 88 hitting the rotation stopper 94. Here, when the trailing end of the recording medium is transported in a reverse direction, the trailing end of the recording medium is guided to the upper surface of the guide portions 88 and then guided to the inverting transport path 52. The inverting transport path 52 is formed between walls 96 and 98. The wall 96 is closer to the apparatus body 12 than the wall 98. The wall 98 is formed on a back side of the device body 60. As described above, the inverting transport path 52 is configured to return the inverted recording medium to the registration rollers 48.

When the guide portion 88 hits the rotation stopper 94, the guide portion 88 rebounds due to a reaction force generated by the guide portion 88 hitting the rotation stopper 94, so that abnormal noise is generated or chattering occurs. The chattering means repeated rebounding.

Figure 4:
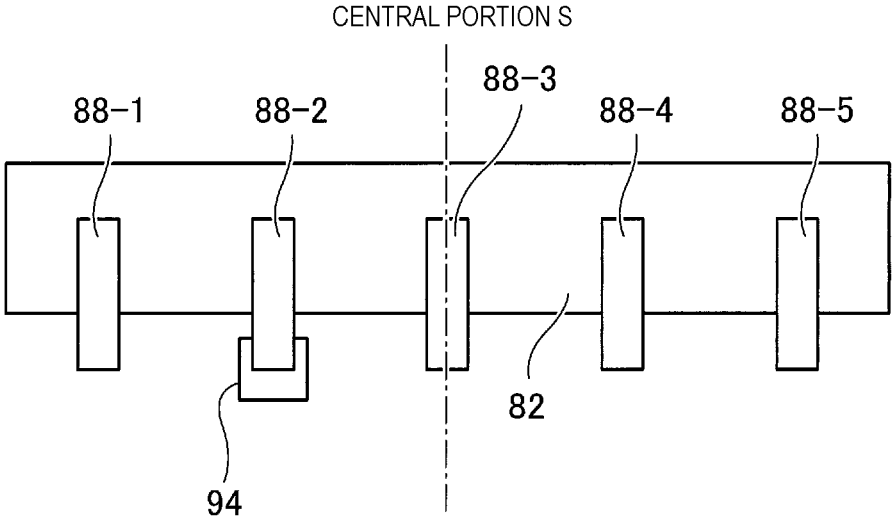
FIG. 4 is a plan view schematically showing the switching device according to the first exemplary embodiment of the present disclosure.

The rotation stopper 94 is disposed asymmetrically in the direction perpendicular to the transport direction in which the switching member 82 transports the recording medium. In FIG. 4, it is assumed that a center portion S of the switching member 82 is an axis of symmetry. In the first exemplary embodiment, for example, the rotation stopper 94 is provided only on the left of the center portion S.

Figure 5:
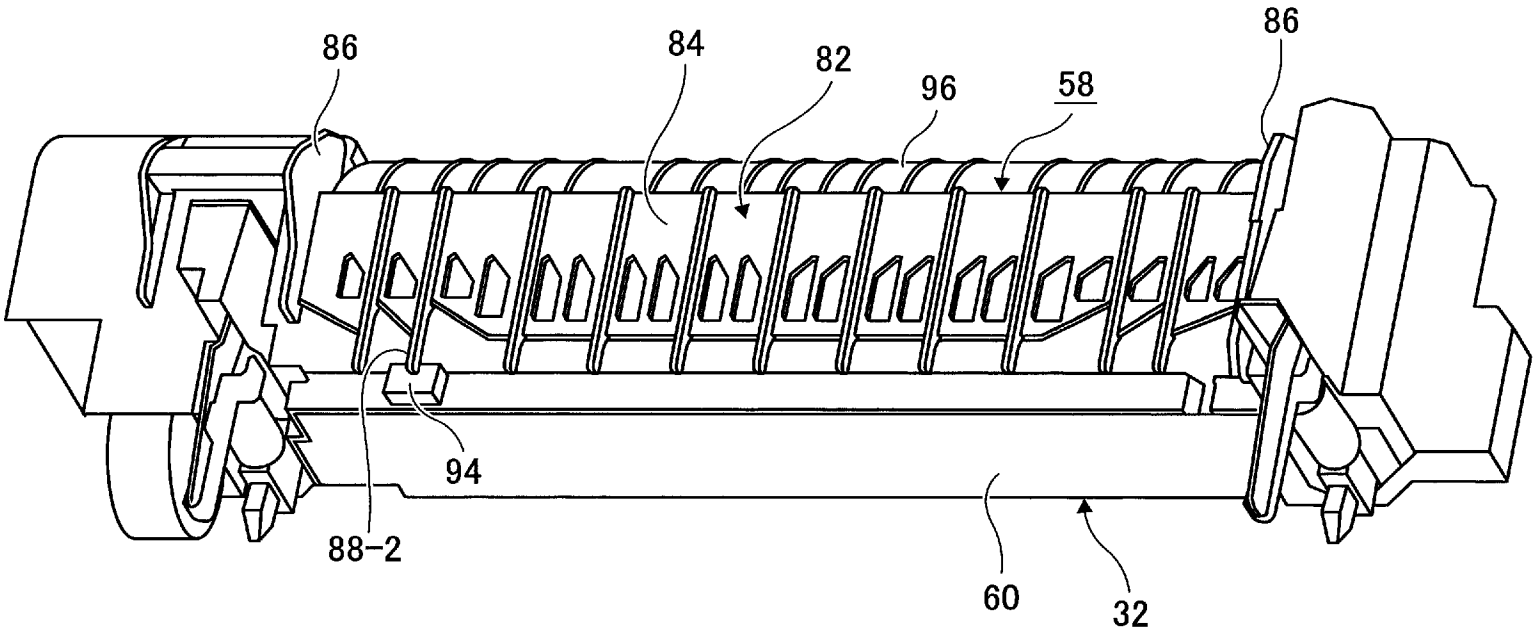
FIG. 5 is a perspective view showing the switching device according to the first exemplary embodiment of the present disclosure.

An example and a comparative example are prepared as follows, and an experiment is carried out to observe the behavior of switching members 82 of the example and comparative example. In the example and comparative example, the switching member 82 is formed with eleven guide portions 88 as shown in FIG. 5. In the example, the rotation stopper 94 is provided corresponding to the second guide portion 88 from the left. In the comparative example, the rotation stoppers 94 are provided corresponding to the rightmost and leftmost guide portions 88.

Figure 6:
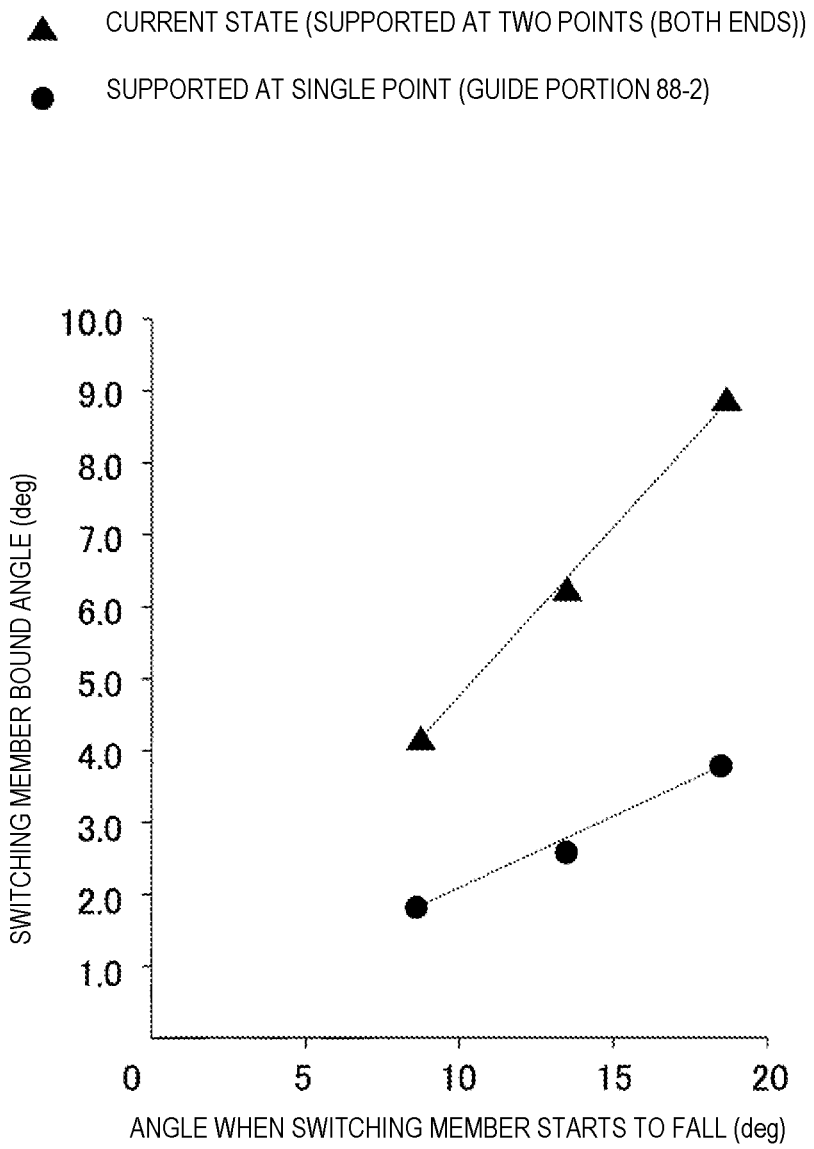
FIG. 6 is a graph showing an example of the switching device according to the first exemplary embodiment of the present disclosure and a comparative example in a comparison manner.

FIG. 6 shows a result obtained by capturing the behaviors of the switching member 82 with a camera. A horizontal axis indicates an angle when the switching member 82 starts to fall. A vertical axis indicates an angle to which the switching member 82 rebounds. In the example, when the angle when the switching member 82 starts to fall is 15 degrees, the rebound angle is 2 degrees, whereas in the comparative example embodiment, the rebound angle is 6 degrees.

It is considered as follows. That is, when the rotation stopper 94 is provided at an asymmetric position, vibration frequencies in the direction perpendicular to the recording medium transport direction of the switching member 82 vary. Thus, vibrations of the switching member 82 cancel each other, so that the vibrations of the switching member 82 are reduced.

Figure 7:
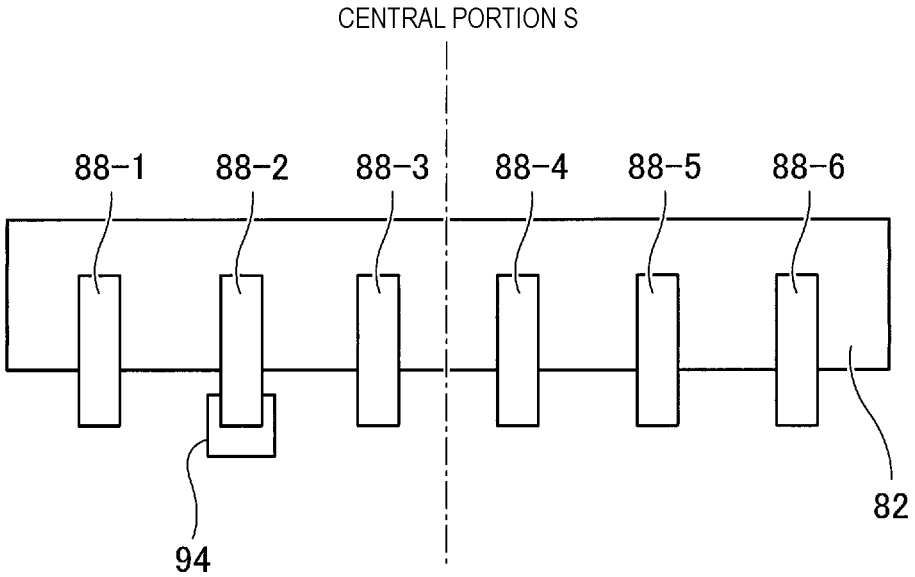
FIG. 7 is a plan view showing a first modification of the switching device according to the first exemplary embodiment of the present disclosure.

As shown in FIG. 4, no rotation stopper 94 is disposed in the central portion S. Here, the phrase "no rotation stopper 94 is disposed in the central portion S" means that when a position suitable for providing the rotation stopper 94 is in contact with the center portion S, the rotation stopper 94 is eliminated. The position suitable for providing the rotation stopper 94 is a position where the guide portion 88 of the switching member 82 is formed. When the number of guide portion 88 of the switching member 82 is an odd number as shown in FIG. 4 (five guide portions 88 in FIG. 4), no rotation stopper 94 is provided at a position corresponding to the central guide portion 88-3. When the number of guide portions 88 is an even number as shown in FIG. 7 (six guide portions 88 in FIG. 7), no rotation stopper is provided at positions facing the guide portions 88-3, 88-4 adjacent to the central portion S.

Figure 8:
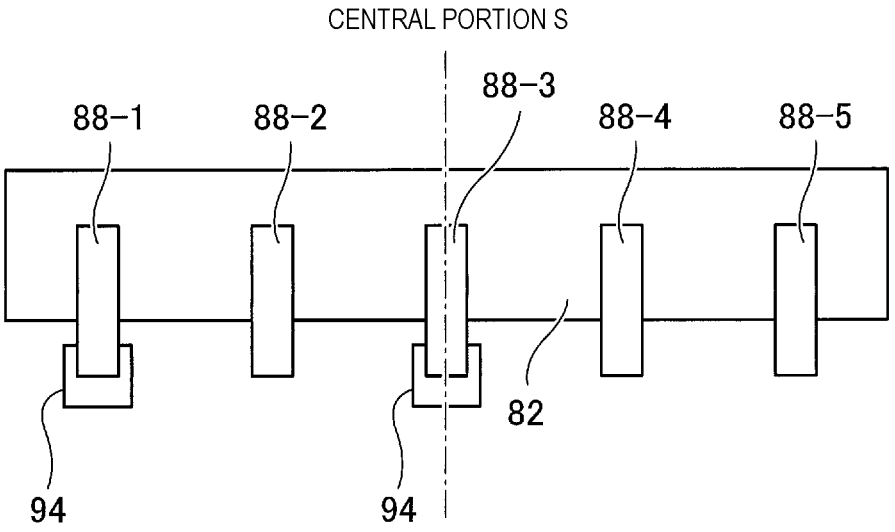
FIG. 8 is a plan view showing a second modification of the switching device according to the first exemplary embodiment of the present disclosure.

It should be noted that when plural rotation stoppers 94 are provided as shown in FIG. 8, one rotation stopper 94 may be provided at a position corresponding to the central portion S of the switching member 82 and another rotation stopper 94 may be provided at an asymmetric position. As described above, as compared with a case where the rotation stopper 94 is provided at a single position, providing of the plural rotation stoppers 94 increases a contact area between the switching member 82 and the rotation stoppers 94. Thereby, the angle to which the switching member 82 rebounds can be further reduced. When the plural rotation stoppers 94 are provided, a material of one of the rotation stoppers 94 may be different from that of at least another one of the rotation stoppers 94. For example, the rotation stopper 94 provided at the position corresponding to the central portion S may be formed of a material that is more easily elastically deformed than that of the discharge guide member 80. The other rotation stopper(s) 94 may be formed of a synthetic resin and integrated with the discharge guide member 80. Accordingly, the vibration frequencies in the direction perpendicular to the recording medium transport direction of the switching member 82 change, so that the angle to which the switching member 82 rebounds can be further reduced.

Figure 9:
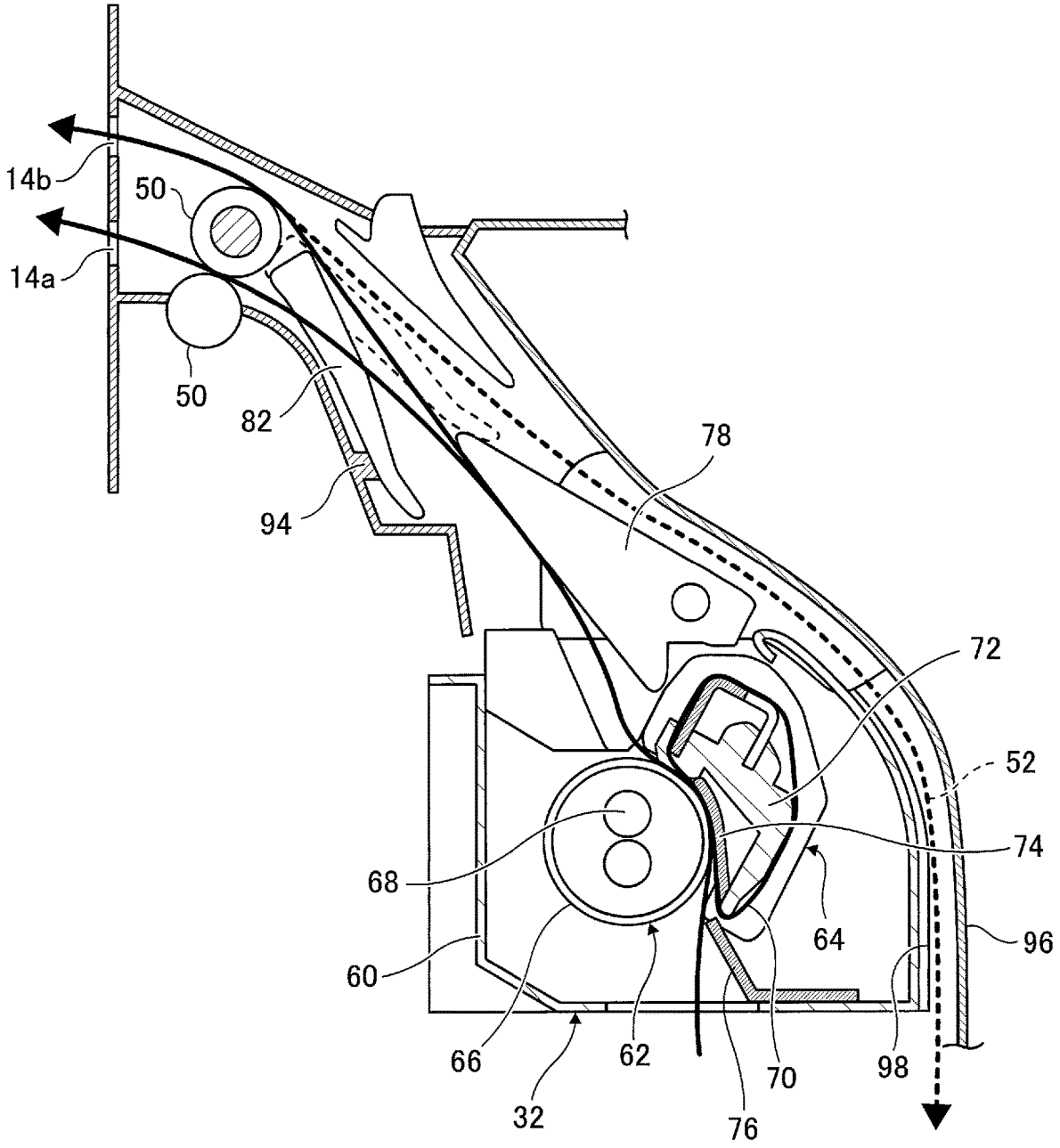
FIG. 9 is a side cross-sectional view showing a switching device according to a second exemplary embodiment of the present disclosure and surroundings thereof.
Figure 10:
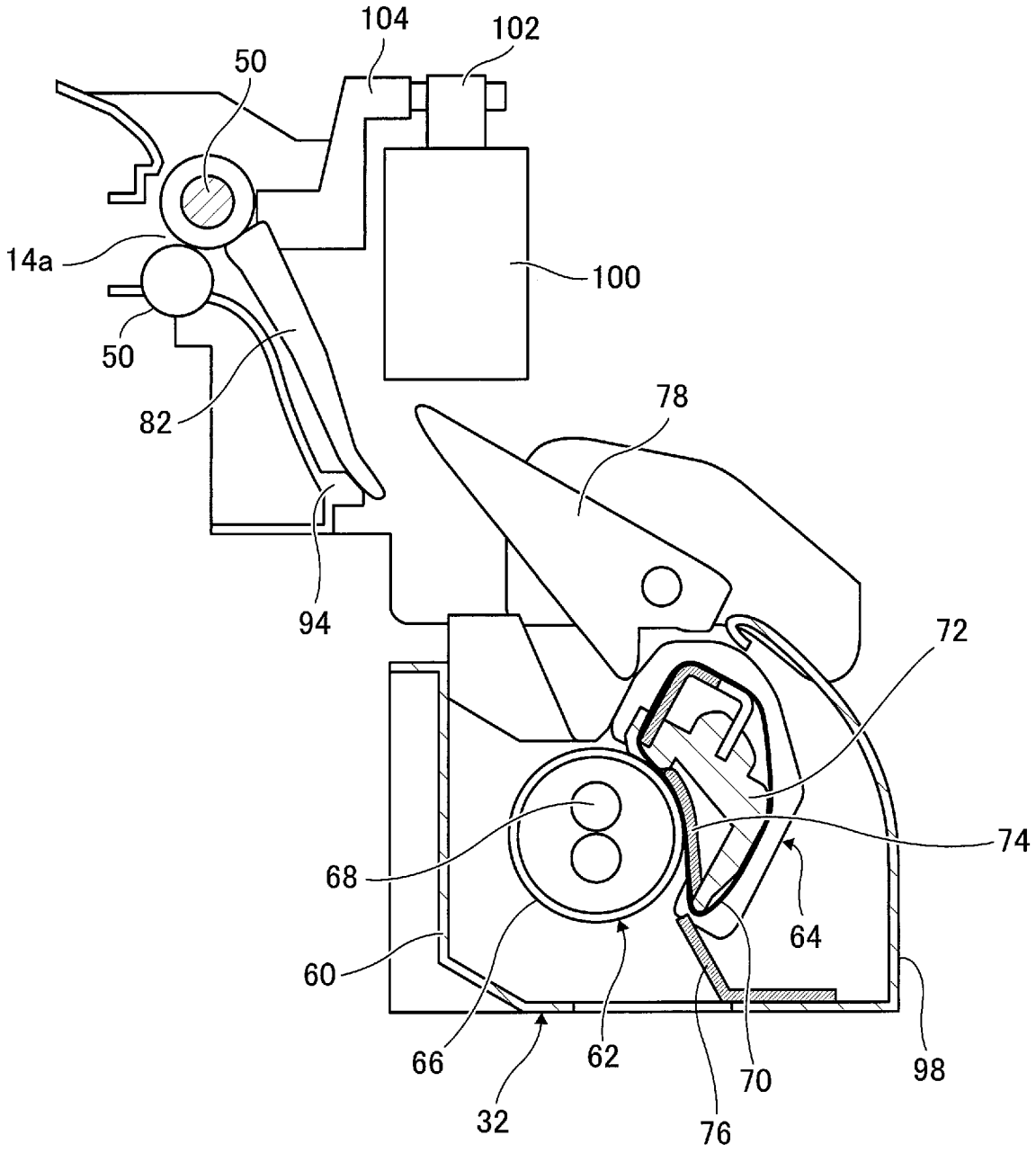
FIG. 10 is a side cross-sectional view showing the switching device, including a solenoid, according to the second exemplary embodiment of the present disclosure, and surroundings thereof.
Figure 11:
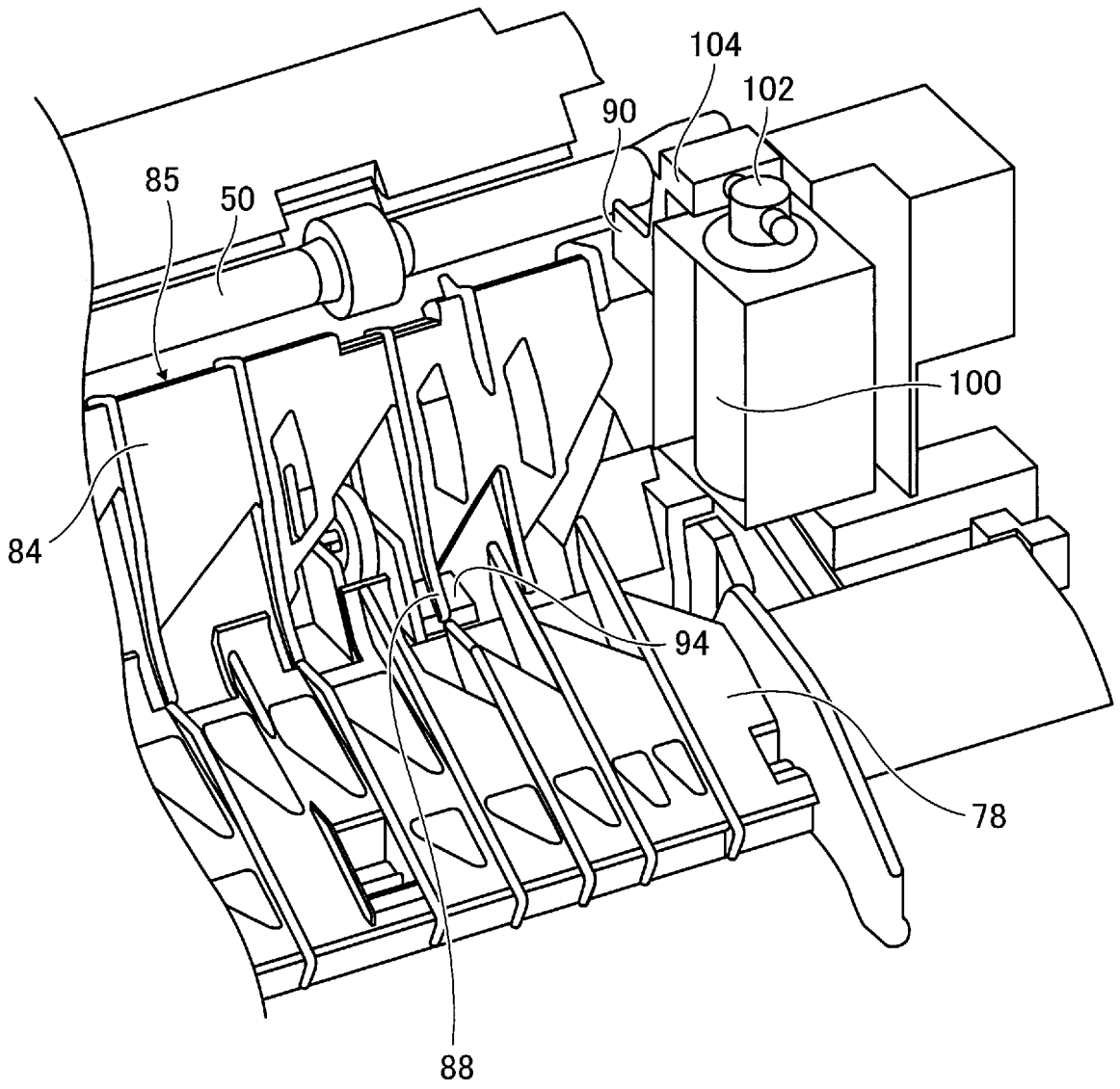
FIG. 11 is a perspective view showing the switching device, including the solenoid, according to the second exemplary embodiment of the present disclosure, and surroundings thereof.

FIGS. 9 to 11 show a second exemplary embodiment according to the present disclosure.

In the first exemplary embodiment, the switching member 82 is driven by the stiffness of the recording medium and the own weight of the switching member 82. On the other hand, in the second exemplary embodiment, the switching member 82 is driven by a solenoid 100.

The solenoid 100 is fixed to the apparatus body 12. A driving shaft 102 extends upward. The driving shaft 102 is moved in upper and lower directions by the solenoid 100. A connecting piece 104 is connected to the driving shaft 102. The connecting piece 104 moves in the upper and lower directions.

The connecting piece 104 is connected to the rotation shaft 90 of the switching member 82 such that when the connecting piece 104 moves in the upper and lower directions, the switching member 82 is rotated clockwise or counterclockwise.

In the second exemplary embodiment, when the switching member 82 is in an upper position, the recording medium is guided to a lower surface of the switching member 82 and discharged toward a first discharge port 14*a* through a position between the two discharge rollers 50, 50. When the switching member 82 is in a lower position, the recording medium is guided to an upper surface of the switching member 82 and transported toward a second discharge port 14*b* by the upper discharge roller 50. When the trailing end of the recording medium enters the switching member 82, the switching member 82 is rotated counterclockwise and is stopped at the upper position. Then, the discharge roller 50 rotates in reverse, so that the recording medium is guided to the inverting transport path 52.

The rotation stopper 94 is provided in the apparatus body 12 such that when the switching member 82 rotates to the lower position, the switching member 82 hits the rotation stopper 94 and the rotation stopper 94 stops the rotation of the switching member 82. Similarly to the first exemplary embodiment, in the second exemplary embodiment, the rotation stopper 94 is disposed asymmetrically in the direction perpendicular to the transport direction in which the switching member 82 transports the recording medium.

In the second exemplary embodiment, the rotation stopper 94 stops the rotation of the switching member 82 when the switching member 82 rotates downward (clockwise). Alternatively, the rotation stopper 94 may be provided above the switching member 82 such that the rotation stopper 94 stops the rotation of the switching member 82 when the switching member 82 rotates upward (counterclockwise).

In the above-described two exemplary embodiments, the elements of the image forming apparatus 10 which relate to discharging of a recording medium switch the transport directions of the recording medium. The present disclosure is not limited to such exemplary embodiments. For example, the present disclosure may be employed in an apparatus that switches directions paths of a recording medium, such as a post-processing apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A switching device for switching transport directions of a recording medium, the switching device comprising:

a switching member configured to switch transport paths of the recording medium; and at least one rotation stopper configured to hit the switching member to stop rotation of the switching member, wherein the at least one rotation stopper is disposed asymmetrically in a direction perpendicular to a transport direction in which the switching member transports the recording medium, wherein the switching member is configured to rotate in one direction due to movement of the recording medium, and rotate in a direction opposite to the one direction via gravitational force, the at least one rotation stopper comprises a plurality of rotation stoppers, and the rotation stoppers are disposed at a plurality of positions, in the direction perpendicular to the transport direction, of the switching member.

2. The switching device according to claim 1, wherein the at least one rotation stopper is disposed at least at one position in the direction perpendicular to the transport direction of the switching member, and no rotation stopper is disposed at a central portion of the switching member in the direction perpendicular to the transport direction of the switching member.

3. The switching device according to claim 1, wherein a material of one of the rotation stoppers is different from that of another one of the rotation stoppers.

4. The switching device according to claim 1, wherein at least one of the rotation stoppers is disposed at a central portion of the switching member in the direction perpendicular to the transport direction of the switching member, and at least another one of the rotation stoppers is disposed at a position other than the central portion of the switching member in the direction perpendicular to the transport direction of the switching member.

5. The switching device according to claim 3, wherein at least one of the rotation stoppers is disposed at a central portion of the switching member in the direction perpendicular to the transport direction of the switching member, and at least another one of the rotation stoppers is disposed at a position other than the central portion of the switching member in the direction perpendicular to the transport direction of the switching member.

6. The switching device according to claim 1, wherein the switching member includes a guide portion configured to come into contact with the recording medium and guide the recording medium, and the rotation stopper is configured to hit the guide portion.

7. A switching device for switching transport directions of a recording medium, the switching device comprising:

a switching member configured to switch transport paths of the recording medium; and at least one rotation stopper configured to hit the switching member to stop rotation of the switching member, wherein the at least one rotation stopper is disposed asymmetrically in a direction perpendicular to a transport direction in which the switching member transports the recording medium, wherein the switching member is configured to rotate in one direction due to movement of the recording medium, and rotate in a direction opposite to the one direction via gravitational force, the at least one rotation stopper is disposed at least at one position in the direction perpendicular to the transport direction of the switching member, no rotation stopper is disposed at a central portion of the switching member in the direction perpendicular to the transport direction of the switching member, the switching member includes a guide portion configured to come into contact with the recording medium and guide the recording medium, and the rotation stopper is configured to hit the guide portion.

8. The switching device according to claim 1, wherein the switching member includes a guide portion configured to come into contact with the recording medium and guide the recording medium, and the rotation stoppers are configured to hit the guide portion.

9. The switching device according to claim 3, wherein the switching member includes a guide portion configured to come into contact with the recording medium and guide the recording medium, and the rotation stoppers are configured to hit the guide portion.

10. The switching device according to claim 4, wherein the switching member includes a guide portion configured to come into contact with the recording medium and guide the recording medium, and the rotation stoppers are configured to hit the guide portion.

11. The switching device according to claim 5, wherein the switching member includes a guide portion configured to come into contact with the recording medium and guide the recording medium, and the rotation stoppers are configured to hit the guide portion.

12. An image forming apparatus comprising:

a transport path on which a recording medium is transported;

an image forming unit configured to form an image on the recording medium transported on the transport path; and a switching device configured to switch transport directions of the recording medium transported on the transport path, wherein the switching device comprises a switching member configured to switch the transport path and another transport path; and a rotation stopper configured to hit the switching member to stop rotation of the switching member, and the rotation stopper is disposed asymmetrically in a direction perpendicular to a transport direction in which the switching member transports the recording medium, wherein the switching member is configured to rotate in one direction due to movement of the recording medium, and rotate in a direction opposite to the one direction via gravitational force, the at least one rotation stopper comprises a plurality of rotation stoppers, and the rotation stoppers are disposed at a plurality of positions, in the direction perpendicular to the transport direction, of the switching member.

13. A switching device for switching transport directions of a recording medium, the switching device comprising:

switching means for switching transport paths of the recording medium; and rotation stopping means for hitting the switching means to stop rotation of the switching means, wherein the rotation stopping means is disposed asymmetrically in a direction perpendicular to a transport direction in which the switching means transports the recording medium.

* * * * *